United States Patent [19]

de la Pintiere et al.

[11] Patent Number: 4,505,323

[45] Date of Patent: Mar. 19, 1985

[54] APPARATUS FOR INSPECTING HEAT EXCHANGER TUBES

[75] Inventors: Louis de la Pintiere, Guichen; Jean Ballereau, Paris, both of France

[73] Assignee: Intercontrole Société Anonyme, France

[21] Appl. No.: 492,232

[22] Filed: May 6, 1983

[30] Foreign Application Priority Data

May 7, 1982 [FR] France ..... 82 07968

[51] Int. Cl.[3] ..... F28G 15/02; F16C 1/12; F16G 9/00

[52] U.S. Cl. ..... 165/11 A; 165/40

[58] Field of Search ..... 165/11 A, 76; 73/40.5 R, 40.5 A, 49.8

[56] References Cited

U.S. PATENT DOCUMENTS

| | | | |
|---|---|---|---|
| 4,004,698 | 1/1977 | Gebelin | 165/76 X |
| 4,172,492 | 10/1979 | Abell et al. | 165/11 A |
| 4,231,419 | 11/1980 | Gugel | 165/11 A |
| 4,278,044 | 7/1981 | French | 118/256 |
| 4,302,146 | 11/1981 | Finlayson et al. | 165/76 X |
| 4,393,920 | 7/1983 | Shima et al. | 165/76 X |
| 4,438,805 | 3/1984 | Gugel | 165/11 A X |

FOREIGN PATENT DOCUMENTS

| | | | |
|---|---|---|---|
| 2339231 | 8/1977 | France . | |
| 2482728 | 11/1981 | France . | |
| 2519761 | 7/1983 | France | 165/11 A |

*Primary Examiner*—Allen M. Ostrager

[57] ABSTRACT

Apparatus for checking the tubes of a heat exchanger in an area spaced by a given distance from the end of said tubes, by means of a probe performing a helical movement, wherein the apparatus comprises a threaded rod, which can be screwed into a nut carried by a positioning and supporting device suspended on the exchanger tubes, first flexible means, which are perfectly rigid in torsion and of constant length ensuring the integral transmission of a rotation torque between the threaded rod and the probe, second flexible means ensuring the integral transmission of said rotation torque between the rotation control means and the threaded rod, a flexible sheath connecting the nut and a fixed chassis external of the exchanger, and means for sliding the assembly constituted by the probe, the first flexible means, the threaded rod and the second flexible means between a rest position in which the probe is placed in the said nut and an inspection position in which the threaded rod engages in the nut.

8 Claims, 2 Drawing Figures

APPARATUS FOR INSPECTING HEAT EXCHANGER TUBES

BACKGROUND OF THE INVENTION

The present invention relates to an apparatus for the inspection of heat exchanger tubes in an area at a given distance from the end of said tubes, by means of a probe, such as an eddy current probe, which performs a helical movement.

Throughout the description, the term "heat exchangers" is used in a general sense to describe all types of exchangers having a bundle of tubes in which circulates a first fluid exchanging its heat with a second fluid circulating about the tubes. This term also covers steam generators.

Heat exchangers generally comprise either straight tubes, or U-shaped tubes. In both cases, the ends of the tubes are sealingly fixed to one or both tube plates, whose thickness is relatively great (e.g. 540 mm for the tube plate of a U-shaped tube steam generator equipping a nuclear power station). The tubes are fixed to the tube plates in such a way that the tube passes through the entire plate and its end is flush with the outer face of the plate defining the collector, (or water box in a steam generator). The actual fixing takes place on the one hand by welding or brazing at said end, and on the other hand by expansion over the entire thickness of the tube plate.

When the fluids circulating in the heat exchanger are corrosive fluids under the operating conditions, as is in particular the case for the heat exchangers used in nuclear power stations, the exchanger tubes form particularly fragile members, particularly at the expanded zone and the transition zone between the expanded parts and the unexpanded parts of the tubes. This is due on the one hand to the tensions produced in the tubes during expansion, and on the other to deposits of corrosive substances, which can occur level with the tube plate.

It is therefore particularly important to periodically check or inspect the tubes of heat exchangers, particularly in the vicinity of the inner face of the tube plate. It is also useful to check the tube plate during the same operation.

In general terms, it is known to check heat exchanger tubes by introducing into them an eddy current probe and by moving the latter forwards and backwards in order to detect defects or faults in the tube.

It is also known to check areas close to the welded or brazed joint by which the end of the tubes is fixed to the outer face of the tube plates, by using an eddy current probe, which carries out a helical movement, as described e.g. in the Intercontrole French Patent Application No. 8,011,295 of May 16, 1980.

In order to check and inspect the tubes at the point where they are fixed by expansion to the tube plate, it would appear necessary to use a device comparable to that known for inspecting the area close to the welded or brazed joint fixing the end of the tubes to the tube plate, i.e. a device comprising an eddy current probe, which performs a helical movement. However, the device described in French Patent Application No. 8,011,295 of May 16, 1980 cannot be used for inspecting the expanded area of the tubes. Thus, bearing in mind the significant thickness of the tube plate (approximately 540 mm for a steam generator equipping a nuclear power station), the probe would then have to be fixed to the end of a rigid rod having a length similar to the thickness of the plate. When the probe is removed from a tube in order to permit its movement up to another tube, it would then be necessary to have a free space, at least equal to the said length facing the front face of the tube plate. However, in existing heat exchangers, the collectors for water boxes are generally hemispherically shaped, in such a way that even if such a space is available in the central part of the tube plate, it is not present on its periphery. Thus, such a device would not make it possible to check tubes located on the periphery of the tube plate, which is obviously unsatisfactory.

Thus, there is a need for a new apparatus making it possible to check the expanded area of heat exchanger tubes. In addition, the helical movement of the probe must be very precise and the angular movements of the probe necessary for the quality of the inspection must be as regular as possible. Thus, the probe must be able to move in an extremely accurate and regular helical manner (pitch of approximately 1 mm over a distance of approximately 50 mm).

The solution of the latter problem is made particularly difficult in view of the impossibility of using a device having a rigid connection between the probe and the means controlling its helical displacement.

SUMMARY OF THE INVENTION

The present invention relates to a novel apparatus, particularly adapted to the checking of the outlet of the expanded area of heat exchanger tubes, which makes it possible to check and inspect all the tubes and which has the desired precision, both with respect to the movement of the probe and with respect to knowing the angular position thereof.

The present invention therefore specifically proposes an apparatus for checking the tubes of a heat exchanger in an area spaced by a given distance from the end of said tubes, by means of a probe performing a helical movement, wherein the apparatus comprises a threaded rod, which can be screwed into a nut carried by a positioning and supporting device suspended on the exchanger tubes, first flexible means, which are perfectly rigid in torsion and of constant length ensuring the integral transmission of a rotation torque between the threaded rod and the probe, second flexible means ensuring the integral transmission of said rotation torque between the rotation control means and the threaded rod, a flexible sheath connecting the nut and a fixed chassis external of the exchanger, and means for sliding the assembly constituted by the probe, the first flexible means, the threaded rod and the second flexible means between a rest position in which the probe is placed in the said nut and an inspection position in which the threaded rod engages in the nut.

The thus defined apparatus has the essential characteristic of having flexible connection means in order to perfectly maintain the rotational and translational movements between the probe and the screw-nut system defining the helical displacement thereof. It is consequently possible to transmit a very precise movement to the probe and to check all the tubes, even when they are fixed to the periphery of the tube plate. Another feature of the apparatus is that there is a complete separation between the means making it possible to control the helical movement of the probe and the means making it possible to displace the latter between its working position and a given distance from the interior of the tube and its rest position, external of the tube permitting its displacement in such a way that it faces another tube.

Preferably, the apparatus according to the invention also comprises means for detecting the engagement of the threaded rod in the nut, whereby said means can control the start of the putting into operation of the control equipment and/or the recording of signals supplied by the probe. Thus, it is possible to ensure that the control or inspection process is only started, when it has been ensured that the threaded rod is well engaged in the nut.

According to another feature of the invention, the first flexible means, the threaded rod and the second flexible means define a passage in which are received the electrical conductors connecting the probe to the supply means and to the processing means, said processing and supply means being external of the exchanger.

According to a particularly advantageous embodiment of the invention, the first flexible means are constituted by a succession of univeral joints, of which there is an even number, and the second flexible means are constituted by a ringed metal sheath, optionally surrounded by a braided protective envelope.

According to an improvement of the invention making it possible to check the ends of tubes below the face of the tube plate with the aid of the same apparatus, the probe can be externally threaded, so that it can be screwed into the nut.

BRIEF DESCRIPTION OF THE DRAWINGS

The invention is described in greater detail hereinafter relative to a non-limitative embodiment and with reference to the attached drawings, wherein show.

DETAILED DESCRIPTION OF THE INVENTION

Figure 1:
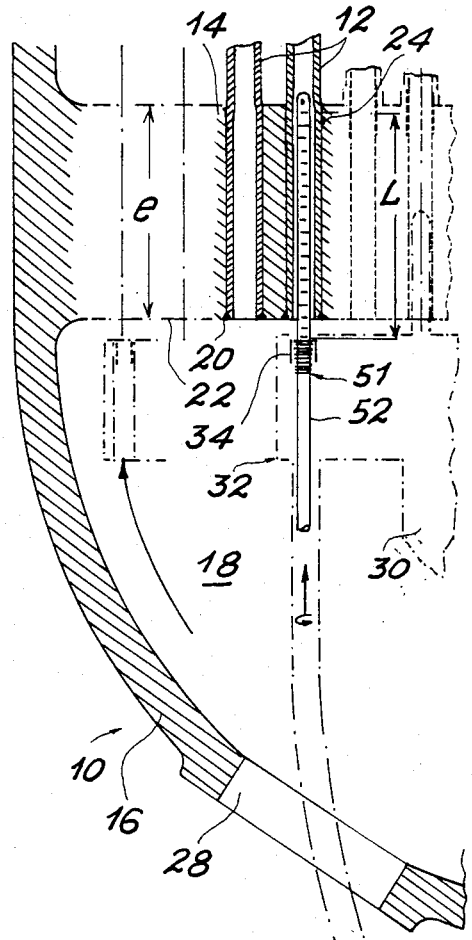
FIG. 1 diagrammatically, an apparatus according to the invention, in the position which it occupies during the inspection of the tubes of a vertical steam generator, whereof only part is shown in the drawing.
Figure 1:
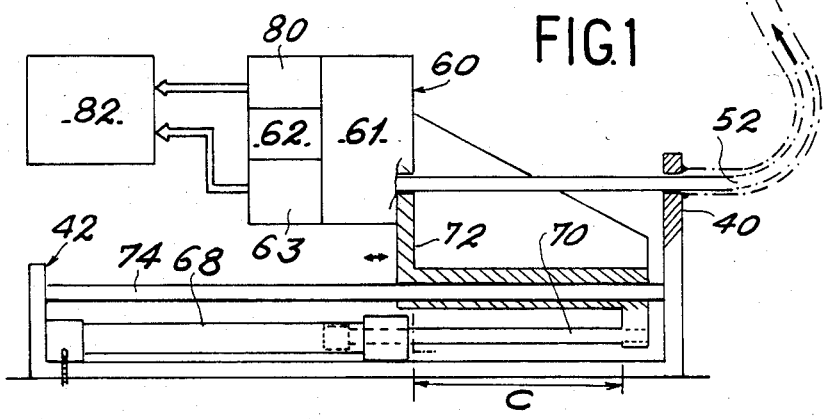

FIG. 1 shows part of the lower end of a vertical steam generator 10 suitable for equipping a nuclear power station. In particular, this steam generator comprises a group of U-shaped tubes 12 fixed by their lower ends to a tube plate 14, defining a water box 18 with a hemispherical wall 16.

For the understanding of the invention, it is sufficient to note that the lower ends of tubes 12 are fixed to the tube plate 14 on the one hand by welded or brazed joints 20 level with the lower face 22 of the tube plate, and on the other hand by expanded portions 24 in the tubes in the vicinity of the upper face 26 of the tube plate. Moreover, wall 16 has a manhole 28, which is normally closed during the operation of the steam generator, but which makes it possible to check the tubes thereof by means of the apparatus according to the invention after the generator has been stopped and emptied.

The apparatus according to the invention firstly comprises a device for positioning and supporting the probe, designated by reference numeral 30 in FIG. 1 and which is not shown in detail, because it can be formed by any known device fulfilling the desired function. This device can in particular be of the type described and claimed in French Patent No. 2,309,314. It should be noted that such a device has the function of supporting an inspection probe or a tool used for repairing the damaged tubes of a heat exchanger and for successively moving the probe or tool in front of each tube. To this end, said device is directly suspended on the tubes of the exchanger and has means making it possible to move in different directions along the rows of tubes, as well as at least one supporting arm 32 for the probe or tool. It should be noted that during an inspection, the device is stationary and consequently defines a fixed reference relative to the tube to be inspected.

According to the invention, the supporting arm 32 carries a fixed nut 34 used, in the manner to be described hereinafter, for defining the helical movement of the probe.

A first end of a flexible sheath 36 is fixed to arm 32 on the side opposite to tube plate 14. As shown in FIG. 1, sheath 36 passes through manhole 28 and is fixed by its opposite end to a plate 40 of a fixed supporting chassis 42, mounted on the exterior of the steam generator.

The actual inspection or checking assembly comprises a probe 44, whose end is tapered to facilitate its introduction into tube 12 and which laterally covers the actual detection member 46. In the usual case when probe 44 is an eddy current probe, detection member 46 comprises two series-connected coils forming a differential probe.

The lower end of probe 44 is fixed to the upper member of a cardan chain 48 constituted by an even number of cardan elements 50, articulated to one another along successive orthogonal pins 49. The use of an even number of elements 50 makes it possible to perform a homokinetic transmission of the movements.

Figure 2:
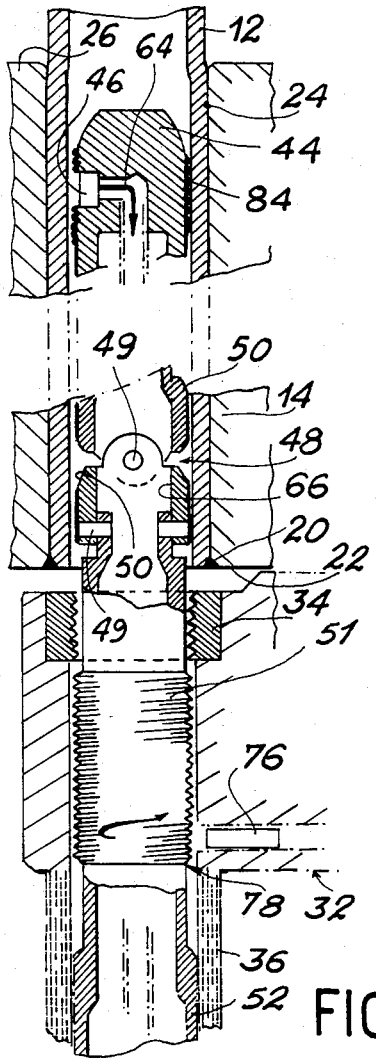
FIG. 2 a larger scale sectional view of the upper part of the inspection apparatus according to the invention.

The lower element of the cardan chain 48 is fixed to the upper part of a threaded rod 51, which can be screwed into nut 34, in the manner illustrated in FIG. 2.

According to the invention, the cardan chain 48 forms a flexible member, whose essential characteristic of having a given length and being incompressible, whilst ensuring a faithful transmission of the rotary movement of the threaded rod 51 to probe 44. The length L of cardan chain 48 corresponds substantially to the thickness e of tube plate 14 (540 mm), so that when the threaded rod 51 is screwed into nut 34, any movement of the threaded rod in the nut is integrally transmitted to probe 44, which thus performs a precise helical movement in the expanded area 24 of tube 12, because nut 34 can then be considered as fixed.

The lower end of threaded rod 51 is fixed to a ringed metal cable 52, which is disposed within sheath 36 and which is thus extended to the outside of the steam generator and is fixed by its opposite end to the output shaft of a motorization block 60. The latter comprises a motor or geared motor 61, electrical supply means 62, processing means 63 and angular coding means 80 formed by a rotary contact.

According to the invention, it should be noted that the ringed metal cable 52 ensures the integral transmission to threaded rod 51 of the rotation torque applied thereto when the motorization block 60 is put into operation. This feature makes it possible to have accurate information on the angular position of probe 44 level with block 60.

Preferably, the electrical supply means 62 of detection member 46, as well as the processing means 63 for the signal supplied by said member are located outside the steam generator in block 60, as is diagrammatically shown in FIG. 1. The transmission of the electrical signals in one or other direction takes place with the aid of electrical conductors 64, which successively pass within the cardan chain 48, within the threaded rod 51 and within cable 52. To this end, a passage 66 is formed within these different elements. More specifically, the yoke of elements 50 of the cardan chain 48, as well as the threaded rod 51 are in each case provided with a passage and cable 52 is in reality shaped like a sheath.

In order to permit the displacement of probe 44 between a low, rest position (not shown) and a high working or inspection position shown in the drawings, means are provided for displacing the assembly constituted by the probe, the cardan chain 48, the threaded rod 51, the cable 52 and the motorization block 60 with respect to chassis 42, sheath 36 and device 30. In the rest position, probe 44 is level with nut 34, so as to permit the displacement of device 30 in order to make the probe face another tube 12. Conversely, in the working position, the probe is positioned in the tube to be inspected, at the upper level of the expanded part 24 thereof. These means for displacing the probe between its rest position and its working position are formed, in the represented embodiment, by a jack 68, whose body is fixed to chassis 42 and whose rod 70 moves parallel to the axis of tube 54, a moving part 72 supporting the motorization block 60. Preferably, the moving part 72 is guided in its movement by one or more columns or slides 74, fixed to chassis 68. The stroke or travel of jack 68 is defined beforehand, in order to control the displacement of probe 44 between its rest position and its working position over a predetermined distance, essentially corresponding to the thickness e of tube plate 14. To this end, the travel C of jack 68 is equal to this predetermined distance, plus a travel for taking up the play between in particular cable 52 and sheath 36.

Preferably, the not shown end of travel contacts are associated with jack 68 in order to accurately determine the position of the moving part 72 and consequently probe 44.

Bearing in mind the nature of cable 52 and sheath 36, which can both be formed by ringed metal, a simple sliding of the cable within the sheath could lead to the former catching on the latter. To prevent this, preferably the geared motor 60 is started up simultaneously with jack 68. Thus, the sliding of the cable within the sheath is accompanied by the rotation of the former, which prevents any catching.

As is in particular illustrated by FIG. 2 there are also means for detecting the satisfactory engagement of threaded rod 51 in nut 34. These means in particular ensure that the processing means 63 for the signal supplied by the probe 44 are not started up until the latter starts its desired helical movement. In the represented variant, these means are constituted by a proximity detector 76, mounted in arm 32 in the vicinity of the inner face thereof, at a level such that it faces a groove 78 formed between threaded rods 51 and cable 52, when said rod 51 is screwed into nut 34 by a given number of threads (e.g. 3). As a result of this arrangement, it is clear that the proximity detector 76 supplies a presence signal until the threaded rod 51 is engaged in the nut, in such a way that groove 78 faces the said detector. The latter then supplies an absence signal, which is used according to the invention for controlling the starting up of the electrical supply means 62 of detection member 46 and the recording means 82 for the signal supplied by said member.

Preferably, with the motorization block 60 are associated means for the angular coding 80 of the position occupied by the probe. Detector 76 is then used for controlling the altitude initialization of said means 80. So that there is no angular drift between the rotary movement performed as from this time by probe 44 and the rotary movement effectively controlled by the motorization block 60 and detected by the coding means 80, it is clearly necessary in the manner indicated hereinbefore for cable 52 to ensure an integral transmission of the torsion couple applied by the motor or geared motor 61 to the threaded rod 51.

As a result of this arrangement, the signal supplied by the means 63 for processing the signal supplied by the detector member 46, as well as the signal supplied by the angular coding means 80 can be used for displaying and/or recording on recording means 82, which can be constituted by any appropriate known device, a curve representing the state of the inspected expanded part 24 of tube 12.

The realization of the apparatus described hereinbefore is simple. When it is necessary to bring the probe 44 into a new tube 12 to be checked and inspected, said probe is moved into the lower rest position within nut 34, carried by device 30. This operation is performed by means of jack 68, which brings about the downward sliding of the assembly constituted by probe 44, cardan chain 48, threaded rod 51 and cable 52 within sheath 36. In this position and in per se known manner, the positioning device 30 can be put into operation in order to make the probe face a tube 12 to be checked. Jack 68 is then put into operation in the reverse direction in order to bring about an upward sliding of the aforementioned assembly and bring the probe 44 to the lower end of the expanded outlet area 24 of the tube 12 to be inspected. In view of the fact that the displacement of the probe, during the inspection under the action of the screw-nut system 50, 34 takes place over a portion of the tube positioned close to the end of expansion area 24, it should be noted that there is no need for this lower position to be accurately known. During this movement towards the working position of probe 44, the latter is preferably rotated by geared motor 61.

The rotation of the latter continues after putting jack 68 into operation, without having any effect on the supply and processing means 62, or on the angular coding means 80, until a start of inspection control signal is supplied by the proximity detector 76. At this time, it is certain that threaded rod 51 is well engaged in nut 34. This signal has the effect of simultaneously controlling the starting up of the electronic processing means 62 and the angular coding means 80, in such a way that the image of the inspected tube is displayed on device 82. Due to the constant length of the cardan chain 48 and the maintaining of the rotary movements authorized by it, the helical movement described by the detection member 46 reproduces with the desired accuracy, the helical movement defined by the rotation of threaded rod 51 in nut 34 controlled by the motorization block 69. In view of the fact that during this movement, nut 34 carried by arm 32 of device 30 can be considered as fixed relative to tube plate 14, the movement of detection member 46 corresponds to the desired helical movement. Moreover, in view of the fact that the rotation torque applied by the motorization block 60 is intergrally transmitted to the threaded rod 51 by cable 52, the rotation detected by the angular coding means 80 corresponds to the rotation of probe 44. It should be noted that the displacement of the probe in the tube is made possible, despite the immobility of the motorization block 60, by the clearance which exists between cable 52 and sheath 36.

When the probe raising movement is at an end, the probe performs the reverse travel, e.g. the rotation of motorization block 60 is reversed and makes it possible to unscrew the threaded rod 51 from nut 34. When this operation is at an end, jack 68 is again put into operation in order to bring the probe into a lower rest position level with nut 34. The positioning device 30 can be actuated in order to bring the probe into a position facing another tube 12 to be inspected and the operations described hereinbefore are performed again.

Obviously, the invention is not limited to the exemplified embodiment described hereinbefore and in fact covers all variants thereof. In particular, the cardan chain 48 could be replaced by any equivalent means making it possible to ensure a perfect maintenance of the movements between the threaded rod 51 and the probe 44. In the same way, cable 52 could be constructed in any other way, provided that the rotation torque exerted by geared motor 61 is retained level with threaded rod 51. Finally, it should be noted that the apparatus described hereinbefore could also be improved in such a way that it can also inspect the welded joint 20 of tubes 12 on tube plate 14. In this connection, FIG. 2 shows that it is possible to control a helical displacement of the detection member 46 at welded joint 20 by modifying probe 44 through adding an external threaded portion 84, which can engage in nut 34.

What is claimed is:

1. An apparatus for checking the tubes of a heat exchanger in an area spaced by a given distance from the end of said tubes, by means of a probe performing a helical movement, wherein the apparatus comprises a threaded rod, which can be screwed into a nut carried by a positioning and supporting device suspended on the exchanger tubes, first flexible means, which are perfectly rigid in torsion and of constant length ensuring the integral transmission of a rotation torque between the threaded rod and the probe, second flexible means ensuring the integral transmission of said rotation torque between rotation control means and the threaded rod, a flexible sheath connecting the nut and a fixed chassis external of the exchanger, and means for sliding the assembly constituted by the probe, the first flexible means, the threaded rod and the second flexible means between a rest position in which the probe is placed in the said nut, level with the latter so as to permit displacement of said device, and an inspection position in which the threaded rod engages in the nut.

2. An apparatus according to claim 1, wherein it also comprises means for detecting the engagement of the threaded rod in the nut, said means controlling the starting of the putting into operation of inspection and recording means for signals supplied by the said probe.

3. An apparatus according to claim 2, wherein the first flexible means, the threaded rod and the second flexible means define a passage in which are received the electrical conductors connecting the probe to supply means and to processing means, said processing and supply means being external of the exchanger.

4. An apparatus according to claim 2, wherein angular coding means, whose putting into operation is also controlled by said means for detecting the engagement of the threaded rod in the nut, are associated with the rotation control means.

5. An apparatus according to claim 1, wherein the first flexible means are constituted by a succession of an even number of cardan elements.

6. An apparatus according to claim 1, wherein the second flexible means are constituted by a ringed metal cable.

7. An apparatus according to claim 1, wherein means are provided for controlling the starting up of the rotation control means, during the starting up of the means for bringing about the sliding of the assembly.

8. An apparatus according to claim 1, wherein the probe has an external threaded portion enabling it to be screwed into the nut, so as to permit the inspection of the ends of tubes.

* * * * *